United States Patent [19]

Szabo

[11] Patent Number: 4,675,638

[45] Date of Patent: Jun. 23, 1987

[54] FERROMAGNETIC MULTIPLE SHELL CORE FOR ELECTRIC COILS

[75] Inventor: Zsolt Szabo, Stuttgart, Fed. Rep. of Germany

[73] Assignee: Dr. Ing. H.C.F. Porsche Aktiengesellschaft, Fed. Rep. of Germany

[21] Appl. No.: 825,349

[22] Filed: Feb. 3, 1986

[30] Foreign Application Priority Data

Feb. 1, 1986 [DE] Fed. Rep. of Germany ..... 3503348

[51] Int. Cl.[4] ..... H01F 27/24; H01F 27/30

[52] U.S. Cl. ..... 336/83; 336/120; 336/212; 336/215; 336/DIG. 2

[58] Field of Search ..... 336/120, 83, 84 M, 215, 336/212, 233, 234, DIG. 2

[56] References Cited

U.S. PATENT DOCUMENTS

| | | | |
|---|---|---|---|
| 2,212,543 | 8/1940 | Jovy | 336/215 X |
| 2,779,926 | 1/1957 | Johnson et al. | 336/212 X |
| 3,196,373 | 7/1965 | Jones et al. | 336/215 X |
| 3,586,964 | 6/1971 | Strauch | 336/84 M X |
| 3,667,342 | 6/1972 | Warnock et al. . | |
| 4,041,431 | 8/1977 | Enoksen | 336/215 X |

FOREIGN PATENT DOCUMENTS

| | | | |
|---|---|---|---|
| 213236 | 6/1956 | Australia | 336/83 |
| 0133802 | 3/1985 | European Pat. Off. . | |
| 1011087 | 6/1957 | Fed. Rep. of Germany . | |
| 1277460 | 9/1968 | Fed. Rep. of Germany . | |
| 1538110 | 1/1970 | Fed. Rep. of Germany | 336/120 |
| 45-33964 | 6/1966 | Japan | 336/120 |
| 57-90909 | 4/1982 | Japan . | |
| 1314021 | 4/1973 | United Kingdom . | |
| 1321940 | 7/1973 | United Kingdom . | |
| 211607 | 11/1968 | U.S.S.R. | 336/83 |

OTHER PUBLICATIONS

"Design of Rotary Transformer", Sakata et al., National Technical Report, vol. 18, No. 4, Aug. 1972, pp. 357–369.

*Primary Examiner*—Thomas J. Kozma
*Attorney, Agent, or Firm*—Barnes & Thornburg

[57] ABSTRACT

A ferromagnetic multiple shell core for a plurality of electric coils has multiple recesses arranged concentrically with respect to one another and separated from one another by concentrically arranged side walls. A central core is provided at a center-point of the concentrically arranged recesses and side walls. The base of the cylindrical shell core has appropriate thickness below each recess to minimize radial tapering of magnetic flux.

12 Claims, 7 Drawing Figures

FERROMAGNETIC MULTIPLE SHELL CORE FOR ELECTRIC COILS

BACKGROUND AND SUMMARY OF THE INVENTION

This invention relates to a ferromagnetic multiple shell core for electric coils.

When using wireless measurement transmission by means of an inductive close-range transmission system, particularly between a stationary machine part or vehicle part and a machine part or vehicle part that is movable with respect to it, the problems of targeting control of the magnetic flow, of reducing stray fields as well as improving the crosstalk attenuation between different signal levels are encountered.

With wireless measured-value transmitting systems, several signals must often be transmitted at the same time. For example, for the operation of a sensor on a rotating machine part or vehicle part, it is necessary to supply the sensor, by means of a (wirelessly transmitted) energy signal, with the energy required for the measurement and the generating of the measurement transmitting signal.

Conventional mass cores or ferrite cores are known, for example, from DE-AS No. 10 11 087. These devices known as shell cores are intended for the enlargement or for the alignment of coil sections. When these are divided into halves and each half is assigned to the stationary and to the movable machine part or vehicle part, they may be used for the bunching of the magnetic flux of an inductive close-range transmitter system.

However, when several signals must be transmitted at the same time via several pairs of coils, it is necessary to wind several coils onto one shell core.

Further, because of the strong inductive coupling on one magnetic circuit and because of the high winding capacitance between the individual coils, a very strong crosstalk of the signals of the individual signal levels is generated that must be eliminated by means of expensive filters before further processing.

DE-AS No. 12 77 460 shows a ferromagnetic multiple shell core for electric coils that mitigates the problem of crosstalk attenuation.

However, due to its arrangement, the multiple shell core is completely unsuitable for the intended purpose because the individual coils are located far away from one another in the core material and are arranged partially vertically to one another.

It is therefore an object of this invention to provide a ferromagnetic multiple shell core for electric coils that has a high crosstalk attenuation between the windings as well as a winding capacitance that is as small as possible.

Another object of the invention is to provide a ferromagnetic shell core for electric coils which is especially suitable for close-range transmission.

A further object of the invention is to provide a ferromagnetic shell core for electric coils which can be produced in a simple and cost-effective way.

These objects are achieved by providing a ferromagnetic shell core for electric coils with a plurality of concentrically arranged side core walls, a bottom core wall and a central core at a center-point of the side core walls. A plurality of concentrically arranged recesses are thus formed between the central core and a side core wall and between each of the side core walls. These recesses house windings of coils.

Advantages of the invention are that a ferromagnetic multiple shell core for electric coils is provided that, because of several separate winding spaces, ensures a good crosstalk attenuation with a low winding capacitance between the individual coils. Because of the good decoupling of the magnetic circuits and the low winding capacitance, high crosstalk attentuations between the different signal circuits can be achieved together with an advantageous mechanical structure. Further, the invention has a compact construction, while the coils are advantageously arranged with respect to space, and can be produced in a simple and cost-effective way.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 1:
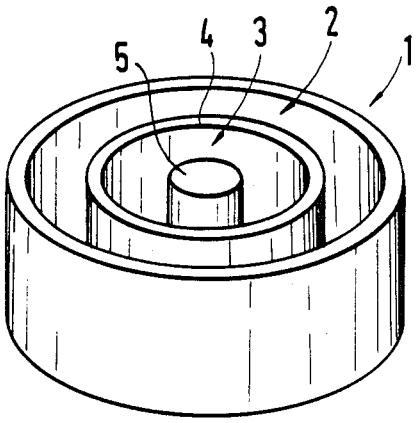
FIG. 1 is a perspective view of a double shell core.
Figure 2:
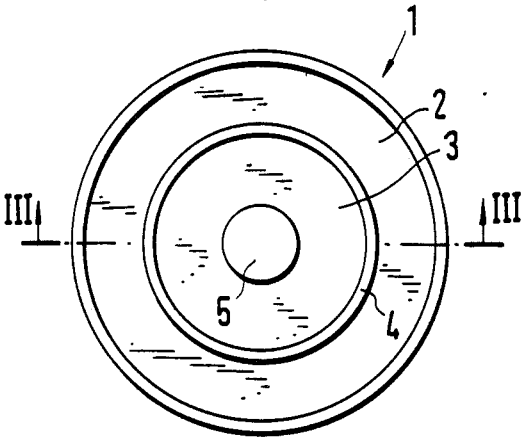
FIG. 2 is a top view of the double shell core according to FIG. 1.

As an example of a ferromagnetic multiple shell core for electric coils, FIG. 1 shows a double shell core 1 in a perspective view. The double shell core 1 has a pot-shaped circular-cylindrical basic shape with circular-ring-shaped exterior 2 and interior 3 recesses that are located concentrically to one another. The exterior recess 2 and the interior recess 3 are separted from one another by a ring-shaped wall 4. A circular-cylindrical central core 5 is arranged in the center.

Figure 3:
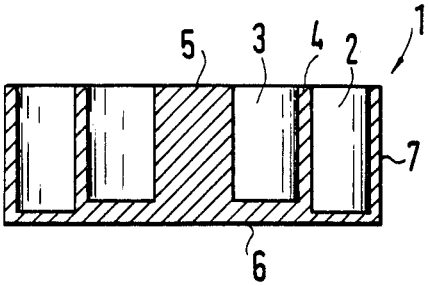
FIG. 3 is a cross-sectional view according to Line III—III of FIG. 2.

As shown in FIG. 3, the thickness of a bottom 6 of the double shell core 1 in the area of the exterior recess 2 and of the interior recess 3 is selected in such a way that a magnetic flux coming from an outside wall 7 or the ring-shaped wall 4 and penetrating the bottom 6 and the central core 5 is subjected to no tapering of the cross-section with respect to the walls 4, 7. The thickness below interior recess 3 is greater than below exterior recesses 2. Further, the magnetic flux coming from the recess 2 and 3 is also subjected to no tapering of the cross-section in the area of the radiuses of the bottom 6 of the exterior recess 2 and the bottom of the interior recess 3 that are located closest to the central core 5. The same is true for the central core 5, which therefore, has a cross-sectional area that corresponds approximately to the sum of the cross-sectional areas of all walls 4, 7.

Figure 7:
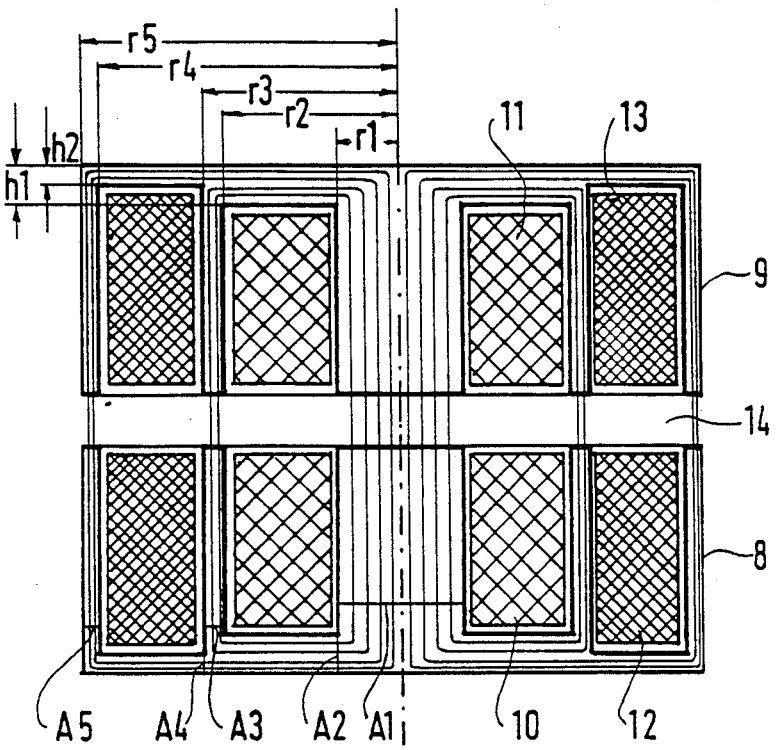
FIG. 7 is a cross-sectional view of the embodiment of FIG. 1 schematically depicting magnetic flux lines.

The lines of flux within the core shell are parallel to each other and in the central core, to the axis of the cylindrical shell. This can best be seen in FIG. 7. The magnetic flux is calculated with the lines of flux B flowing through a cross-section area A. The cross-sectional areas of interest in the preferred embodiment of the shell core of the present invention are defined as:

A.1: circular-shaped area with radius r1, total area: $\pi(r1)^2$

A.2: cylinder shell-shaped area with radius r1 and height h1, total area: $2\pi r1\ h1$ A3: annular-shaped area with inner radius r2 and outer radius r3, total area: $\pi(r3)^2-(r2)^2)$ A4: cylinder-shell shaped area with radius r3 and height h2, total area: $2\ \pi r3h2$ A5: annular-shaped area with inner radius r4 and outer radius r5, total area: $\pi(r5)^2-(r4)^2)$ The specific radiuses and heights are chosen such that A4=A5 and A1=A2=A3+A4=A3+A5. This geometry ensures that the magnetic flux in the area of the bottom does not penetrate at any location a cross-section smaller than the one in the area of the shell surfaces of the shell core.

Note that a portion of the field produced by the inner coil 10 also penetrates sections A4 and A5. Also, a portion of the field produced by the coil 13 penetrates the cross-section A3. However, the effects of these fields on the above sections are negligible due to the chosen geometry of the arrangement according to the present invention.

Figure 4:
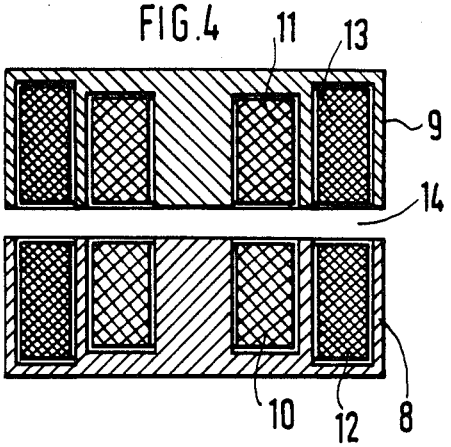
FIG. 4 is a cross-sectional view of two double shell cores in one embodiment of the invention as a part of an inductive measured-value transmitting system.

According to FIG. 4, double-chamber shell cores 8, 9 are arranged so that they are mirror-inverted with respect to one another and each has an interior winding 10, 11 and an exterior winding 12, 13 representing a part of an inductive close-range transmission system, such as a tire pressure control system. The double shell core 9 is mounted at a rotating machine part or vehicle part (not shown), such as a vehicle wheel, and the double shell core 8 is mounted at a part that is stationary relative to said rotating part (not shown), such as a wheel support. For each rotation of the wheel, the double shell cores 8, 9 encounter one another once as shown, so that the coils 10, 11 and 12, 13 are inductively coupled with one another via an air gap 14 and can be used for the signal transmission.

Figure 6:
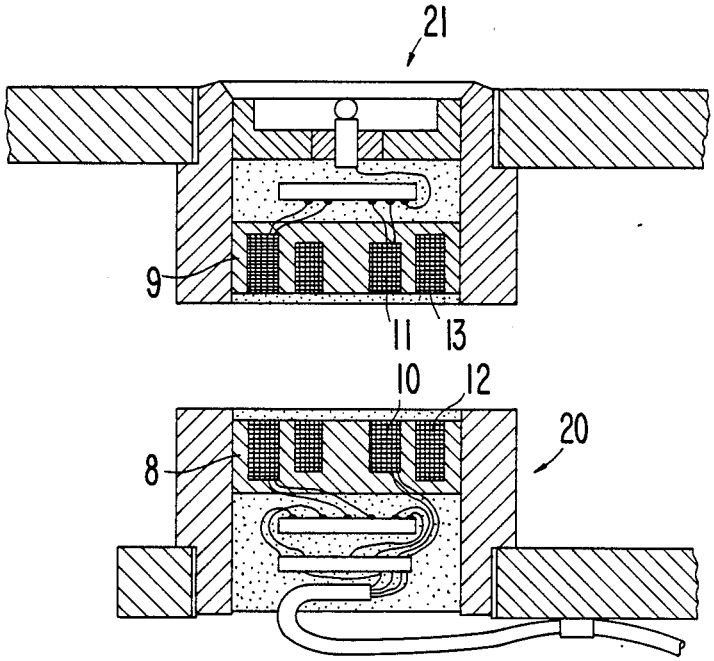
FIG. 6 is a cross-sectional view of an embodiment of the invention as an inductive close-range transmitter system.

As shown in FIG. 6, by means of the interior pair 10, 11 of coils, an energy signal may, for example, be transmitted from the wheel support 20 for the operation of a tire pressure sensor 21 mounted on the wheel. Also, by means of the exterior pair 12, 13 of coils, a measuring signal of a higher frequency and modulated by a measured value is transmitted from the tire pressure sensor 21 to the wheel support 20, and from there, to an evaluating unit. The details of the circuitry are disclosed in German Patent application No. 35 03 347.9 which is hereby incorporated by reference.

A system that is constructed in this way also permits relatively large air gaps 14 and permits a relatively large lateral offset without noticeably impairing the transmission qualities.

Figure 5:
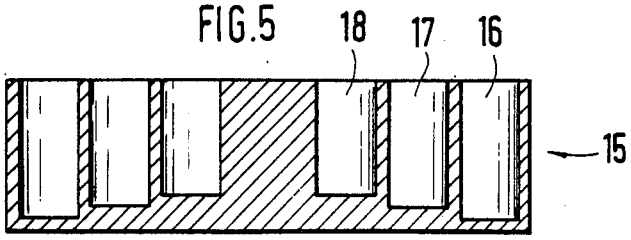
FIG. 5 is a cross-sectional view of another embodiment of the invention.

FIG. 5 shows a triple shell core 15 having exterior 16, central 17 and interior 18 recesses in which a total of three coils can be disposed. In this way, the number of recesses can be expanded and can be individually adapted to the corresponding application of the particular shell core.

As in FIG. 3, the thickness of the bottom and the walls of recesses 16, 17 and 18 are selected to minimize flux tapering. The thickness below recesses 16, 17, and 18 have increasing thickness.

Naturally, the use of multiple shell cores of this type is not limited to tire pressure control systems, but can be used for practically all types of inductive close-range transmission systems in which more than one signal must be transmitted. These cores are particularly useful for arrangements in which a machine part or vehicle part can be moved relative to another part or relative to any stationary object.

When the double shell cores 8, 9 are placed directly on top of one another and are screwed together with one another, according to FIG. 4, they can also be used as a core for transmitter systems with a galvanic separation between the windings.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. A ferromagnetic shell core for a plurality of electric coils comprising:

a cylindrical bottom core wall, a plurality of concentrically closed ring-shaped spaced side core walls and a central core extending from said bottom core wall; said bottom core wall, central core and side core walls being ferromagnetic material; and a plurality of concentrically arranged recesses formed between said bottom core wall, said central core and one of said side core walls and between said bottom core wall and each of said side core walls, each for housing windings of a respective coil, wherein the bottom core wall includes a substantially planar surface, said recess located closest to the central core terminating in said bottom core wall a further distance from said substantially planar surface than said recess located further away from the central core to provide increasing amounts of core material from a point between said substantially planar surface and an outermost recess to the central core.

2. A ferromagnetic shell core as in claim 1, wherein said bottom core wall in the area of the respective recesses has a thickness to compensate for tapering of the cross-section of the magnetic flux in the area of the side core walls and in the area of the radiuses of the bottom core wall of the respective recesses located closest to the central core, said magnetic flux coming from an interior side core wall and an exterior side core wall and penetrating the bottom core wall and central core.

3. A ferromagnetic shell core as in claim 1, wherein the central core has a cross-sectional area corresponding approximately to the sum of cross-sectional areas of all of the side core walls.

4. An inductive close-range transmitter system comprising: a first and second shell core each having a cylindrical bottom core wall, a plurality of concentrically closed ring-shaped spaced side core walls and a central core extending from said bottom core wall; said bottom core wall, central core and side walls being ferromagnetic material; and a plurality of concentrically arranged recesses formed between said bottom core wall, said central core and one of said side core walls and between said bottom core wall and each of said side core walls, each housing a respective coil, wherein the bottom core wall includes a substantially planar surface, said recess located closest to the central core terminating in said bottom core wall a further distance from said substantially planar surface than said recess located further away from the central core to provide increasing amounts of core a point between said substantially planar surface and an outermost recess the central core.

5. An inductive close-range transmitter system as in claim 4, wherein said first shell core is movable relative to said second shell core in an orbit and said shell cores being opposite each other at least once in said orbit.

6. An inductive close-range transmitter system as in claim 5, including first means connected to a first coil pair for transmitting and receiving energy signals between said shell cores and second means connected to a second coil pair for transmitting and receiving measurement signals between said shell cores.

7. An inductive close-range transmitter system as in claim 6, wherein said first coil pair is concentrically interior said second coil pair.

8. An inductive close-range transmitter system as in claim 7, wherein said second means transmits signals at higher frequency than said first means.

9. An inductive close-range transmitter system as in claim 4, including first means connected to a first coil pair for transmitting and receiving energy signals between said shell cores and second means connected to a second coil pair for transmitting and receiving measurement signals between said shell cores.

10. An inductive close-range transmitter system as in claim 9, wherein said first coil pair is concentrically interior said second coil pair.

11. An inductive close-range transmitter system as in claim 10, wherein said second means transmits signals at higher frequency than said first means.

12. A ferromagnetic shell core as in claim 1 wherein (a) A1 is a cross-sectional area of the central core, (b) A2 is a surface area of a cylinder having a radius equal to a radially interior edge of an inner recess, and a height equal to a thickness of the bottom core wall in an area of the inner recess, (c) A3 is an annular cross-section of an inner side core wall, (d) A4 is a surface area of a cylinder having a radius equal to a radially interior edge of an outer recess and a height equal to a thickness of the bottom core wall in an area of the outer recess, (e) A5 is annular cross-section of an outer side core wall, and wherein $A4=A5$ and $A1=A2=A3+A4=A3+A5$.

* * * * *